US010455961B2

(12) United States Patent
Shine et al.

(10) Patent No.: US 10,455,961 B2
(45) Date of Patent: Oct. 29, 2019

(54) ADAPTIVE HANDCUFF FOR PROGRESSIVE FEEDING UTENSILS

(71) Applicants: Kayla Shine, Irmo, SC (US); Alexa Eyring, Chapin, SC (US)

(72) Inventors: Kayla Shine, Irmo, SC (US); Alexa Eyring, Chapin, SC (US)

( * ) Notice: Subject to any disclaimer, the term of this patent is extended or adjusted under 35 U.S.C. 154(b) by 0 days.

(21) Appl. No.: 15/725,844

(22) Filed: Oct. 5, 2017

(65) Prior Publication Data

US 2018/0092479 A1 Apr. 5, 2018

Related U.S. Application Data

(60) Provisional application No. 62/404,553, filed on Oct. 5, 2016.

(51) Int. Cl.

| | |
|---|---|
| ***A47G 21/04*** | (2006.01) |
| ***A47G 21/02*** | (2006.01) |
| ***A47G 21/08*** | (2006.01) |

(52) U.S. Cl.

CPC ..... *A47G 21/04* (2013.01); *A47G 21/02* (2013.01); *A47G 21/023* (2013.01); *A47G 21/08* (2013.01)

(58) Field of Classification Search

CPC ..... A47G 21/04; A47G 21/02; A47G 21/08; A47G 21/023

See application file for complete search history.

(56) References Cited

U.S. PATENT DOCUMENTS

| | | | | |
|---|---|---|---|---|
| 2,942,342 | A * | 6/1960 | Warren | A47G 21/04 30/327 |
| 5,075,975 | A | 12/1991 | Wilson | |
| 5,373,643 | A * | 12/1994 | Warren | A47G 21/02 30/322 |
| 5,860,190 | A | 1/1999 | Cano | |
| 9,161,643 | B2 * | 10/2015 | Prokop, III | A45D 24/14 |
| 2007/0079514 | A1 * | 4/2007 | Currie | A47G 21/02 30/324 |
| 2008/0178471 | A1 | 7/2008 | Rosario-Solis | |
| 2008/0256807 | A1 * | 10/2008 | Kirkup | A47G 21/02 30/147 |
| 2008/0276466 | A1 * | 11/2008 | Currie | A47G 21/02 30/327 |
| 2014/0373862 | A1 * | 12/2014 | Prokop, III | A45D 24/14 132/150 |

* cited by examiner

*Primary Examiner* — Omar Flores Sanchez

(74) *Attorney, Agent, or Firm* — Kim and Lahey Law Firm, LLC; Douglas Kim

(57) ABSTRACT

The invention is directed to a progressive feeding apparatus comprising: a handle assembly having a handle arch and handle grip; a free end included in the handle arch that extends past an end of the handle grip; a utensil attached to the handle assembly having a downward angle in the range of 30° and 70°, a twist offset angle of 10° or greater, and a lateral offset angle in the range of 5° and 90°. A distal cross-section area can be unequal to a proximal cross-section area of the handle grip. A weight can be disposed in a cavity defined in the handle grip. The weight can be positionable within the cavity and configured to modify a center of gravity of the handle assembly.

7 Claims, 4 Drawing Sheets

ADAPTIVE HANDCUFF FOR PROGRESSIVE FEEDING UTENSILS

CLAIM OF PRIORITY

This application claims priority on U.S. Provisional Patent Application Ser. No. 62/404,553 filed Oct. 5, 2016.

BACKGROUND OF THE INVENTION

1) Field of the Invention

The present invention relates to an improved handcuff and utensil for assisting users who are physically challenged when using utensils.

2) Description of Related Art

Cerebral Palsy affects approximately 764,000 children and adults and approximately 500,000 children under the age of 18. Spina Bifida affects approximately 1,500 live births. Stroke affects approximately 795,000 people each year. Traumatic Brain Injury (TBI) affects approximately 1.7 million people and spinal cord injury affects between 240,000 to 337,000 people. These medical conditions can cause physical disability that affects the individual's body movement, muscle control, and the function of fine motor skills such as those used to eat and drink, handle and manipulate eating utensils, and the like.

Attempts has been made to design utensils and tools, such as forks and spoons, to assist these affected individuals with feeding themselves and other tasks. For example, U.S. Pat. No. 5,075,975 is directed to an Eating Utensil For The Manually Impaired And General Public and discloses a utensil that includes a handle which permits the person's index finger and palm to be supported entirely along the upper surface of the utensil.

U.S. Pat. No. 5,860,190 is directed to an Expanded Implement Handle Grip that is a handle grip for placing over an implement handle of a spoon, fork, knife, toothbrush, hand tool, or the like which has improved concave features within the hollow, interior space. These concave features, which include, but are not limited to dimples, grooves, spiral grooves, indentations, impressions, channels, depressions, hollows, slits, and the like, to permit the implement handle to be easily inserted into the grip, but nevertheless more effectively held by the expanded implement handle grip while being employed by a user with limited dexterity or strength.

United States Patent Application Publication 2008/0178471 is directed to a Novel Handle And Hand Held Utensils that includes a handle having a support for the internal and external parts of the user hand via an aperture in the center that surrounds the user hand.

U.S. Pat. No. 5,373,643 is directed to an Enhanced Eating Implements For A Handicapped Person and includes a first connecting member connected at one end of the gripping member to one end of the barrier member. A second connecting member releasably connects another end of the gripping member to another end of the barrier member. A hand insertion port is formed by an inner perimeter of the gripping member, the barrier member, the first connecting member, and the second connecting member. There is a stabilizing member connected to the gripping member.

However, none of these prior attempts provide a utensil that can mitigate the negative effects on using such a utensil caused by the medical affliction as described herein.

Accordingly, it is an object of the present invention to provide for a novel design of a utensil that can counteract or assist in the mitigation of the physical effects of the medical conditions described herein on an individual performing task such as using such utensil, eating and the like.

It is another object of the present invention to provide for a utensil that can progressive assist with the physical therapy of the user.

SUMMARY OF THE INVENTION

The above objectives are accomplished according to the present invention by providing a eating utensil that includes counterweights, removable attachments for reusable end members such as spoons and forks, grips, are dishwasher safe, and wherein the spoon can include high walls and a funnel. In one embodiment, the utensil can include a dual material to promote bite comfort wherein a more rigid bottom can be used with the upper portion having a higher flexibility or resiliency. In one case the bottom portion can be rigid. For example, in a spoon, the curved bottom portion can be rigid and the side walls a flexible material.

The present invention is directed to an adaptive handcuff for progressive feeding utensils comprising: a head having a flat portion, distal end and proximal end; a handle attached to the head; and, a utensil attached to the head/handle having a downward and sidewise angle. Ridges can be defined in the handle that are cooperatively associated with the fingers of the user. Weights can be placed in a cavity defined in the handle. The utensil can be a spoon having high walls and a funnel at the spoon's tip. The head can be attached to the handle at the distal end and the proximal end or the proximal end can be free. The handle can have a cross section that taken from the group consisting of triangle, rectangle, polygon, circle, oval, or any combination thereof. The cross section area can be generally consistent through the handle or can increase or decrease from the distal end to the proximal end of the handle.

The invention can include a handle arch having a head, a curved portion, a connection portion, and a free end; a handle grip having a cavity for receiving the connection portion of the handle arch wherein the handle grip has a distal cross-section area unequal to a proximal cross-section area; a weight positionally disposed in the cavity of the handle grip; and, a utensil attached to the head of the handle arch having a downward angle in the range of 30° and 70°, a first angle of 10° or greater, and a lateral offset angle in the range of 5° and 90°. The free end can extend past an end of the handle grip and is perpendicular to a flat portion included in the handle arch. The utensil can be removably attached to the handle arch and selected from a group consisting of a knife, fork, spoon, or any combination thereof. The invention can include a polygon cross-section included in the handle grip; a triangular cross-section included in the handle grip; indentions defined in an edge of the handle grip. A resilient material can be carried by the indentions, handle grip or be defined in an underside of the handle arch.

The utensil can be a spoon having walls disposed around a rim and a funnel disposed at a tip. The handle arch can be removably attached to the handle grip.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1B:
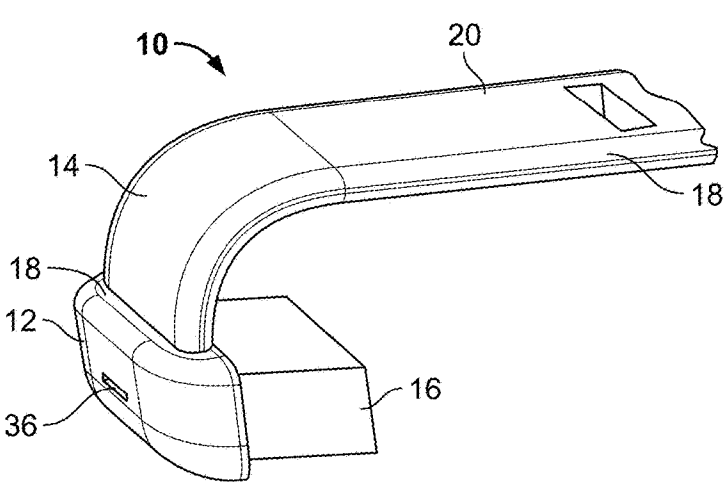
FIG. 1B is a perspective view of aspects of the invention.
Figure 1A:
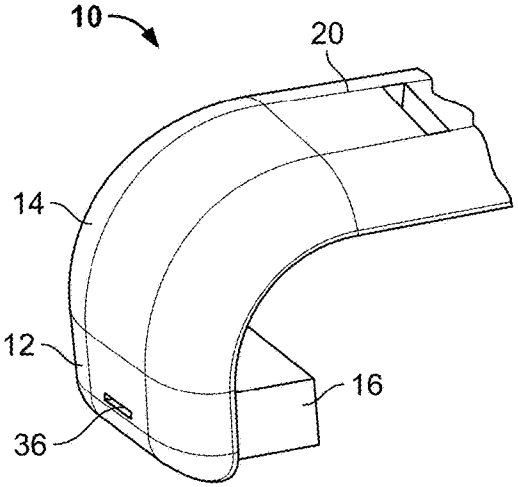
FIG. 1A is a perspective view of aspects of the invention.

Referring to FIGS. 1A and 1B, a handle arch 10 of the present invention in shown. The handle arch can include a head 12, a curved surface 14, a flat portion 20, a connection portion 16, and a free end 18. In one embodiment, the curved portion can define a ridge 20 between the head and the curved portion. The cross section of the curved portion can have an area less than that of the free end, in one embodiment.

The handle arch can include the physical properties of a length in the range of 2.0 to 4.0 inches, a connection portion having a width of about 0.75 inches height of about 0.5 inches, curved portion arch height of about 0.75 inches, curved portion arch width of about 1 inch, and a curved portion arch width if the range of 0.1 to 0.5 inches.

The dimension for several embodiment is shown below in Table 1:

TABLE 1

(inches)

| Embodiment | Length | Insert | Arch height | Arch width | Arch depth |
|---|---|---|---|---|---|
| 1 | 2.5 | 0.75 × 0.5 | 0.875 | 1.0 | 0.4 |
| 2 | 2.5 | 0.75 × 0.5 | 0.875 | 1.0 | 0.2 |
| 3 | 3.0 | 0.75 × 0.5 | 0.875 | 1.0 | 0.2 |
| 4 | 3.5 | 0.75 × 0.5 | 0.875 | 1.0 | 0.2 |

An implement, such as a fork, spoon, knife, or any combination can be received into implement opening 36.

Figure 2:
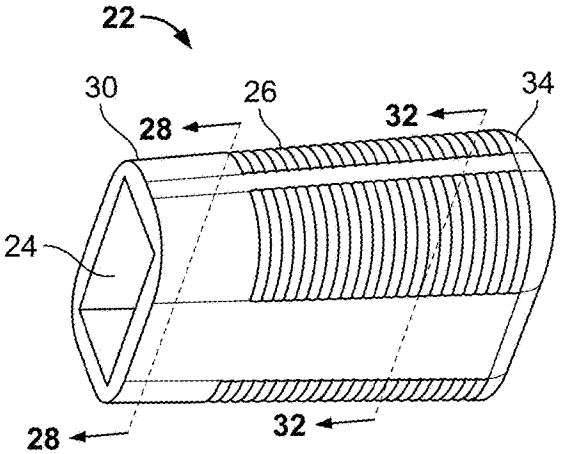
FIG. 2 is a perspective view of aspects of the invention.

Referring to FIG. 2, a handle grip 22 can receive the handle arch and include a handle arch opening 24 that receives the connection portion of the handle arch to form the handle assembly. The handle grip can include ridges 26 to assist with gripping the handle. The handle grip can include a cross section 28 area at the distal end 30 and a cross section 32 and the proximal end 34 wherein the area of the cross section at the distal end is less than the area of the cross section at the proximal end. The area of the cross section can increase along the handle from the distal end to the proximal end.

Figure 3B:
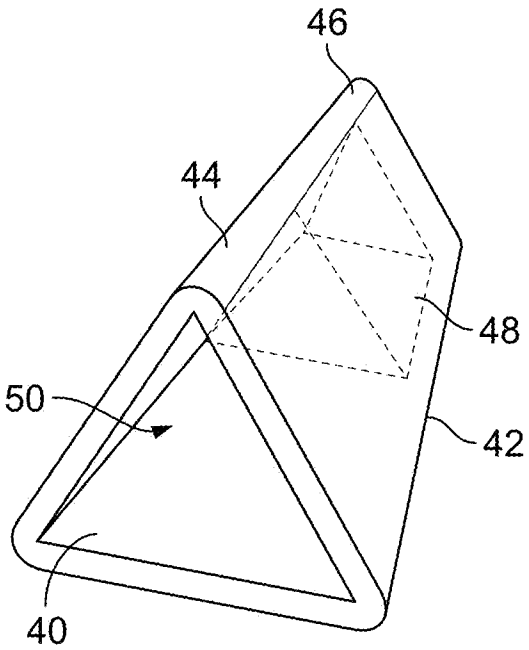
FIG. 3B is a perspective view of aspects of the invention.
Figure 3A:
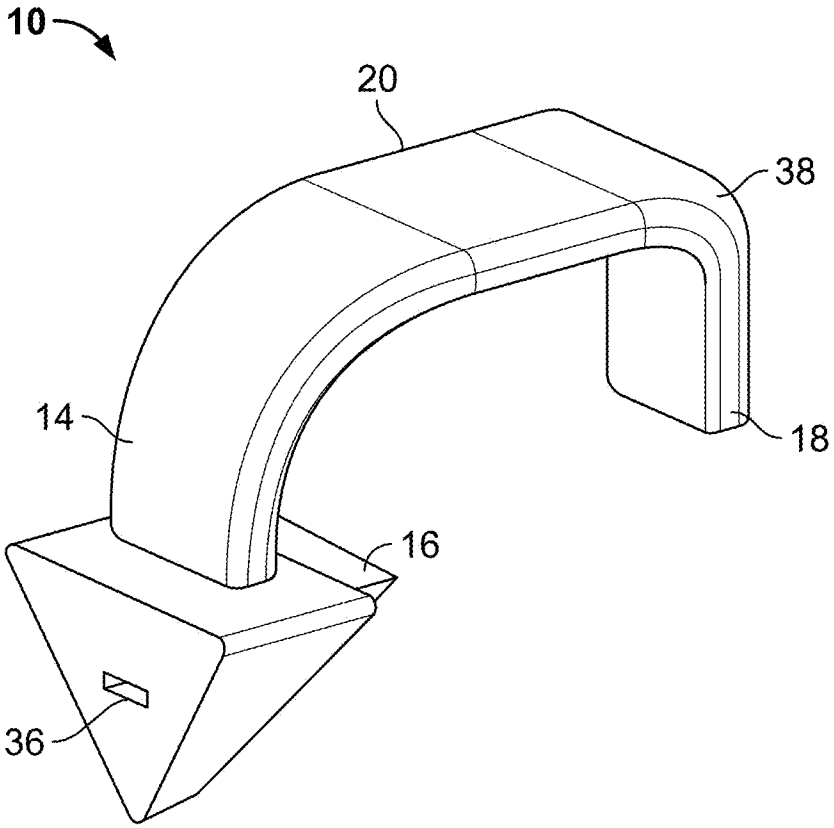
FIG. 3A is a perspective view of aspects of the invention.

Referring to FIGS. 3A and 3B, one embodiment of the present invention is shown. The handle arch 10 can include a distal curved portion 14, a flat portion 20 and a proximal curved portion 38. The free end 18 can be generally perpendicular to the flat end. The connection portion 16 can be triangular to be received into a triangular opening 40 of the handle grip. The handle can be triangular and include indentions 42 along the bottom side of the handle to engage with the fingers of the user. The handle and head can be in various sizes such as to accommodate adults and children. The area of the cross section of distal end 44 can have a larger area than that of the cross section of the proximal end 46 in one embodiment. The area of the cross section of distal end 44 can have a smaller area than that of the cross section of the proximal end 46 in one embodiment. The cross section area of the handle can gradually increase or decrease from the distal end to the proximal end to facilitate an easier fit in the hands of the user. Weight 48 can be placed in a cavity 50 defined in the handle grip to provide additional support and to counteract the physical effect of the medical conditions of the user. The weight can be varied by the user so that the adult version can include heaver weights while the child version can include less weight. The weight can be solid or a soft weight and can be positioned along the cavity to modify the center of gravity of the handle grip allowing the balance to be customized for the user. The weight can be removably received in the cavity and secured in the cavity when the handle arch and handle grip are assembled.

The handle grip can have physical properties that include a length in the range of 2.0 to 3.5 inches, side width in the range of 0.5 to 2.0 inches, insert width in the range of 0.5 to 1.5 inches, insert depth in the range of 2.0 to 3.0 inches. In one embodiment the handle grip has a length of 2.5 inches, side width of 1.0 inches, insert width of 0.8 inches, and insert depth of 2.3 inches. In one embodiment, the handle grip has a length of 3.0 inches, side width of 1.4 inches, insert width of 1.2 inches, and insert depth of 2.8 inches. The handle arch can have physical properties that include a length of 2.0 to 4.0 inches, an arch height in the range of 0.25 to 2.0 inches, an insert width in the range of 0.5 and 1.5 inches and an insert depth about 0.75 inches. In one embodiment the handle arch has a length of 3.0 inches, arch height of 1.2 inches, insert width of 1.2 inches and insert depth of 0.75 inches. In one embodiment, the handle arch has a length of 2.5 inches, arch height of 0.5 inches, insert width of 0.8 inches, and insert depth of 0.75 inches.

Figure 4:
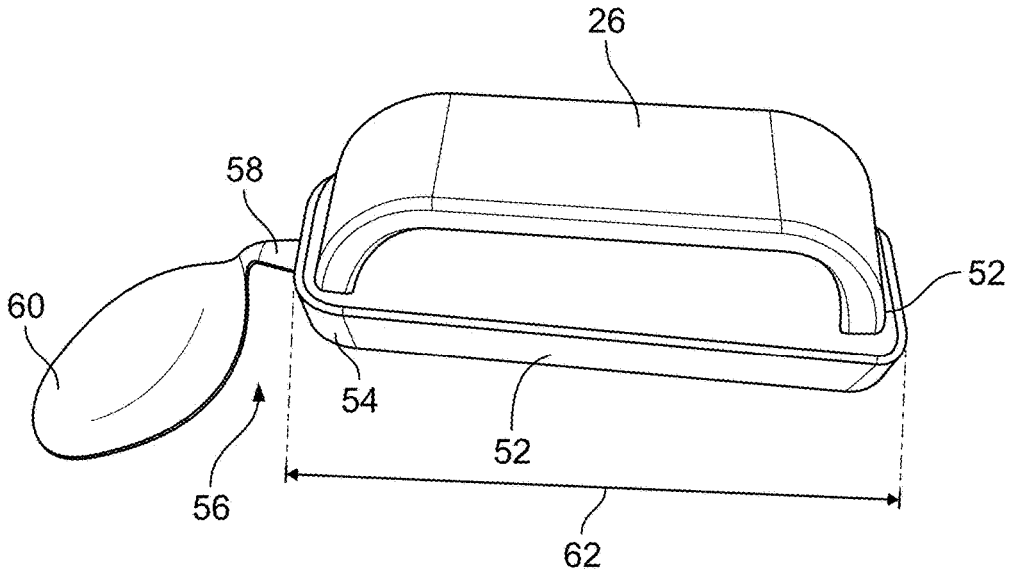
FIG. 4 is a perspective view of aspects of the invention.
Figure 5:
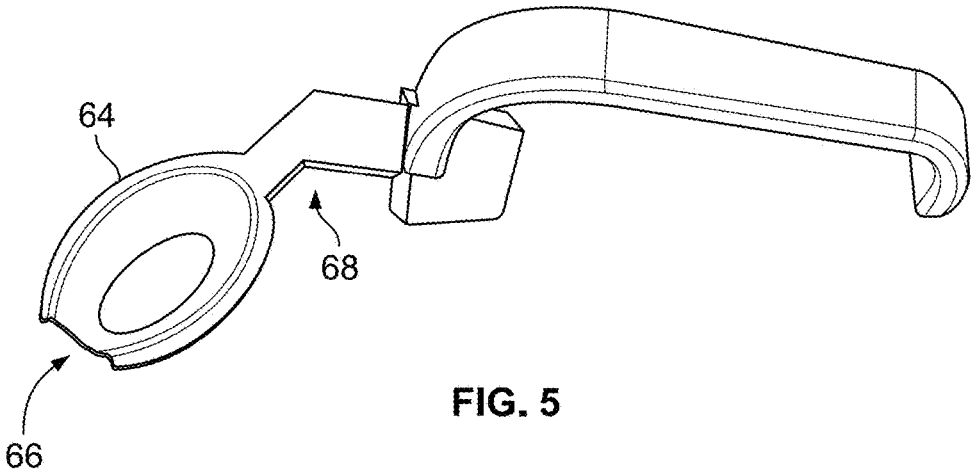
FIG. 5 is a perspective view of aspects of the invention.

Referring to FIG. 4, a generally rounded handle grip 52 is shown attached to the handle arch. The handle arch is attached as connection end 54. An implement 56 is attached to the handle arch. In one embodiment, the implement can include the stem portion 58 and utensil portion 60. The utensil portion can be a knife, spoon, fork, spork, pincher, tool, and the like. The utensil can be angled downward relative to a long axis 62 running longwise along the handle. The utensil can be angled to the left or right of the long axis. In one embodiment, the proximal end of the head can be attached to the handle at 52. Referring to FIG. 5, the utensil can be have a spoon like configuration with high walls 64, funnel construction 66, and be angled 68.

Figure 6:
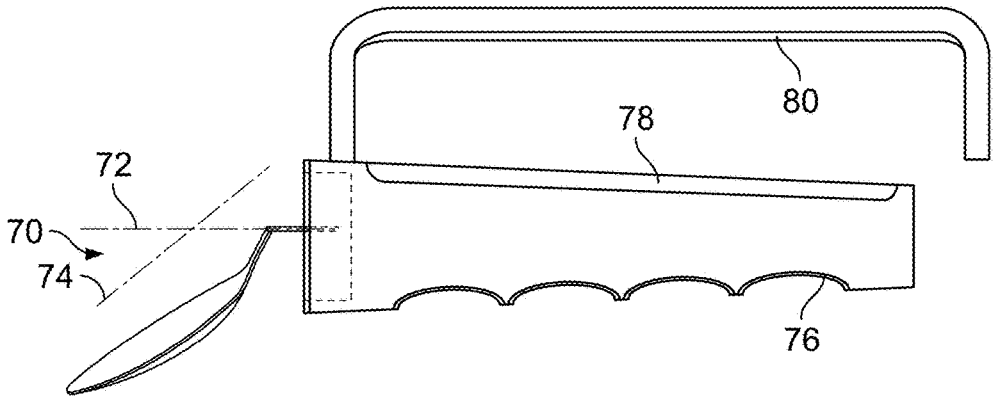
FIG. 6 is a side view of aspects of the invention.

Referring to FIG. 6, the downward angle 70 can be defined between a handle axis 72 and a utensil axis 74. In one embodiment, the angle can be in the range of 30° and 70°. In one embodiment, the angle can be in the range of 65°±10°. In one embodiment, the angle can be in the range of 65°±5°. The handle grip can include indention resilient material 76 disposed in the indentions to provide comfort and improve grip for the user. The handle grip can include grip resilient material 78 disposed on the top of the handle grip improve comfort and grip for the user. The handle arch can include arch resilient material 80 disposed on an underside of the handle arch to improve grip for the user. In one embodiment, the resilient material is silicone.

Figure 7:
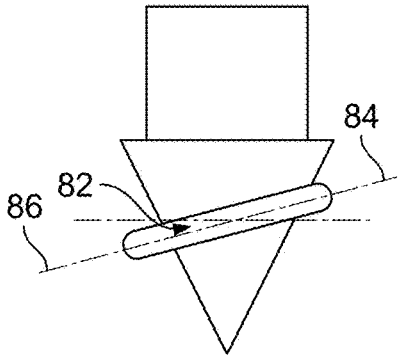
FIG. 7 is a front view of aspects of the invention; and,
FIG. 8 is a top view of aspects of the invention.
Figure 8:
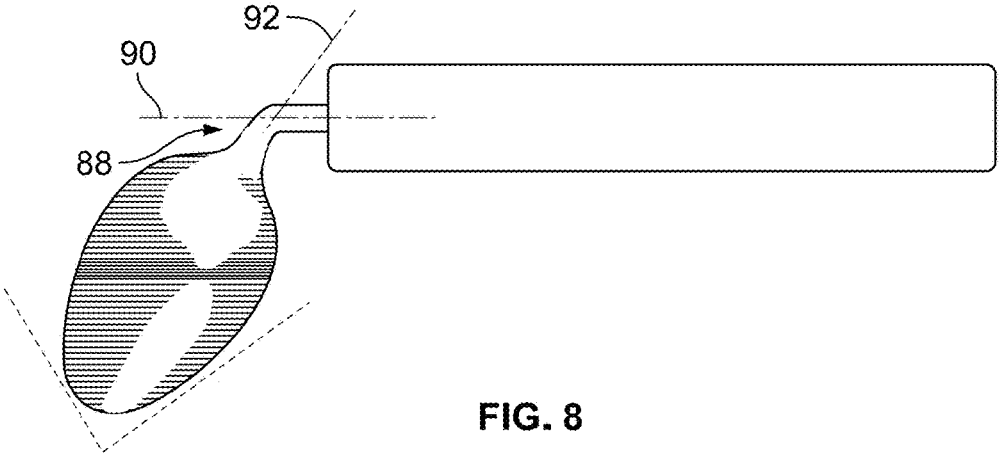

Referring to FIG. 7, the utensil can include a twist angle 82 defined by a grip lateral axis 84 and a utensil lateral axis 86. In one embodiment the twist offset angle can be greater than 10°. In one embodiment, the twist offset angle can be in the range of 10° and 50°. In one embodiment, the twist offset angle can be in the range of 10° and 50°. In one embodiment, the twist offset angle can be in the range of 10° and 35°. In one embodiment, the twist offset angle can be 15°±10°. The twist offset angle is shown for right handed use, the invention can be configured for left handed use with the physical properties being mirrored.

Referring to FIG. 7, a lateral offset angle 88 is shown defined by a lengthwise handle axis 90 and a lengthwise utensil axis 92. In one embodiment, the lateral offset angle is in the range of 5° and 90°.In one embodiment, the lateral offset angle is in the range of 10° and 80°.In one embodiment, the lateral offset angle is in the range of 10° and 55°.In one embodiment, the lateral offset angle is 50°±10°.In one embodiment, the lateral offset angle is in the range of 10° and 55°.In one embodiment, the lateral offset angle is 55°±5°.The lateral offset angle is shown for right handed use, the invention can be configured for left handed use with the physical properties being mirrored.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits, and advantages will be apparent from the above in conjunction with the accompanying examples, data, figures, and all reasonable inferences to be drawn therefrom, alone or with consideration of the references incorporated herein.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A progressive feeding apparatus comprising:

a handle arch having a head, a curved portion, a connection portion, and a free end;

a handle grip having a cavity for receiving the connection portion of the handle arch wherein the handle grip has a distal cross-section area unequal to a proximal cross-section area;

a weight positionablely disposed in the cavity of the handle grip; and, a utensil attached to the head of the handle arch having a downward angle defined between a handle axis and a utensil axis in the range of 30° and 70°, a first angle defined between a grip lateral axis and a utensil axis of 10° or greater, and a lateral offset angle defined between a lengthwise handle axis and a lengthwise utensil axis in the range of 5° and 90°.

2. The apparatus of claim 1 wherein the free end extends past an end of the handle grip and is perpendicular to a flat portion included in the handle arch.

3. The apparatus of claim 1 wherein the utensil is removably attached to the handle arch and selected from a group consisting of a knife, fork, spoon, or any combination thereof.

4. The apparatus of claim 1 including a polygon cross-section included in the handle grip.

5. The apparatus of claim 1 including a resilient material carried by the handle grip.

6. The apparatus of claim 1 including a resilient member carried by an underside of the handle arch.

7. The apparatus of claim 1 wherein the handle arch is removably attached to the handle grip.

* * * * *